United States Patent [19]

Yoshitomi et al.

[11] Patent Number: 4,692,193

[45] Date of Patent: Sep. 8, 1987

[54] PROCESS FOR PRODUCING A GRAIN-ORIENTED ELECTRICAL STEEL SHEET HAVING A LOW WATT LOSS

[75] Inventors: Yasunari Yoshitomi; Katsuro Kuroki; Kenzo Iwayama, all of Kitakyushu, Japan

[73] Assignee: Nippon Steel Corporation, Tokyo, Japan

[21] Appl. No.: 791,294

[22] Filed: Oct. 25, 1985

[30] Foreign Application Priority Data

Oct. 31, 1984 [JP] Japan ..... 59-228014

[51] Int. Cl.[4] ..... H01F 1/04

[52] U.S. Cl. ..... 148/111; 148/113; 148/308

[58] Field of Search ..... 148/111, 110, 112, 113

[56] References Cited

U.S. PATENT DOCUMENTS

| | | | |
|---|---|---|---|
| 2,287,466 | 6/1942 | Carpenter | 148/111 |
| 2,287,467 | 6/1942 | Carpenter et al. | 148/111 |
| 3,218,202 | 11/1965 | Ganz | 148/111 |
| 3,278,348 | 10/1966 | Foster et al. | 148/111 |
| 3,855,020 | 12/1974 | Salsgiver et al. | 148/111 |
| 3,905,842 | 9/1975 | Grenoble | 148/111 |
| 3,954,521 | 5/1976 | Malagari | 148/111 |
| 4,517,032 | 5/1985 | Goto et al. | 148/111 |

FOREIGN PATENT DOCUMENTS

| | | | |
|---|---|---|---|
| 684297 | 4/1964 | Canada | 148/111 |

*Primary Examiner*—John P. Sheehan

*Attorney, Agent, or Firm*—Kenyon & Kenyon

[57] ABSTRACT

A thin-gauge (0.10–0.23 mm thick) grain-oriented electrical steel sheet is produced by a process characterized by a decarburization which is carried out after the hot-rolling and before the final cold-rolling, after which the known, decarburization annealing and finishing annealing are carried out. The steel composition is adjusted to induce the secondary recrystallization by the AlN inhibitor. The reduction at the final cold-rolling is determined to be high to obtain a high magnetic flux density but tends to instabilize the secondary recrystallization unless the inventive decarburization is carried out.

4 Claims, 6 Drawing Figures

0.2 mm

CENTER OF SHEET THICKNESS 0.2mm

PROCESS FOR PRODUCING A GRAIN-ORIENTED ELECTRICAL STEEL SHEET HAVING A LOW WATT LOSS

BACKGROUND OF THE INVENTION

1. Field of the Invention

The present invention relates to a process for producing a grain-oriented electrical steel sheet having a high magnetic flux density, a thin sheet thickness, and an improved watt loss characteristic, which sheet being used for the cores of a transformer and the like.

2. Description of the Related Art

The grain-oriented electrical steel sheet is a soft magnetic material used mainly as the core material of a transformer and other electrical machinery and apparatuses. The magnetic properties required for the grain-oriented electrical steel sheet are an excellent exciting characteristic, which is usually numerically represented by $B_8$ (the magnetic flux density at a magnetic field intensity of 800 A/m), and an excellent watt loss, which is usually numerically represented by $W_{17/50}$ (the watt loss per kg at a magnetization up to 1.7 T and 50 Hz).

The grain-oriented electrical steel sheet is obtained usually by utilizing the secondary recrystallization phenomenon and developing the so called Goss texture having a {110} plane on the steel sheet surface and a <001> axis in the rolling direction. To obtain excellent magnetic properties, it is important to align the <001> axis, which is an easy direction of magnetization, in the rolling direction at a high degree of accuracy. In addition to the orientation, the sheet thickness, the grain size, the resistivity, the surface coating, and the purity of a steel sheet have a great influence on the magnetic properties. The orientation can be drastically enhanced by using methods, in which MnS and AlN are used as the inhibitors and a final cold-rolling is carried out at a heavy draft. In accordance with the enhancement of orientation, the watt loss also can be drastically improved.

Note, the recent large increases in energy costs have forced the manufacturers of transformers to demand more low-watt loss materials for transformers. Amorphous alloys and 6.5% Si steels are being developed as materials having low watt loss but there are problems yet to be solved, concerning their use as transformer materials. A measure for lessening the sheet thickness of a grain-oriented electrical steel sheet promises to lessen the watt loss, because, as known heretofore, such a measure is effective for lessening the eddy current loss, which amounts to 70% or more of the watt loss. Therefore, endeavors have been made to lessen the sheet thickness. The majority of conventional grain-oriented electrical steel sheets are, however, approximately 0.30 mm thick. This thickness was determined by the requirements for assembling the transformer parts. However, together with recent strong demands for saving energy, the need to decreasing the sheet thickness is prevailing over the need to enhance the assembling efficiency, with the result that the transformer manufacturers now tend to use sheets 0.20 mm or less thick. From the point of view of the steel makers, the production of thin gauge-grain-oriented electrical steel sheet involves a problem in that the secondary recrystallization becomes difficult. One reason for this is that a great reduction is necessary for producing thin products from hot-rolled steel sheets having a predetermined thickness, and the texture of the steel sheets is detrimentally influenced by this heavy reduction. This can be eliminated by lessening the sheet thickness of the hot-rolled strips, but this incurs another problem. That is, the finishing temperature of the hot-rolling process is inevitably lowered when the hot-rolled strip has a thin sheet thickness, with the result that the AlN- and MnS- precipitation is promoted and an excessive precipitation size is yielded which is detrimental to the magnetic properties.

Since the measures for lessening the sheet thickness and hence improving the texture are limited, an additional intermediate step must be introduced to the production process. That is, after the hot-rolling, a cold-rolling, an intermediate annealing, and a cold-rolling for reducing the sheet until a predetermined thickness is obtained at a predetermined reduction rate, are successively carried out. In this process, the secondary recrystallization is considerably stabilized and a high magnetic flux density is easily attained. However, this process is unsatisfactory for obtaining products which are 0.18 mm or less in thickness and have improved magnetic properties. One reason for this is that nonhomogeneous regions remain in the structure of the intermediate product and frequently cause linear failure regions in the secondary recrystallization. To overcome drawbacks resulting from nonhomogenity, U.S. Pat. No. 3,632,456 proposes to anneal the hot-rolled strip prior to the first cold-rolling. In this process, the secondary recrystallization is firmly stabilized in products having a sheet thickness as low as 0.14 mm. Such stabilization may be attributable to the high recrystallization degree of the primarily cold-rolled and then annealed sheet, and to a drastic improvement in the structure of the decarburization annealed sheet. The decarburization annealing of the cold-rolled sheet determines the basic structure from which the secondary recrystallization develops. In this process, however, despite the stability of the secondary recrystallization, the magnetic flux density decreases.

Japanese Unexamined Patent Publication No. 58-55530 discloses to decarburize the product at a step later than the hot-rolling and earlier than the completion of final cold-rolling. The magnetic properties are allegedly improved by such an intermediate decarburization. The components of the steels, to which the inventive process of the above publication is applied, are those not using the AlN inhibitor, and the reduction degree at the final cold-rolling is from 40 to 80%.

SUMMARY OF THE INVENTION

It is an object of the present invention to eliminate the drawbacks that, when producing a 0.10~0.23 mm thick grain-oriented electrical steel sheet exhibiting a high magnetic flux density due to the use of an inhibitor mainly composed of AlN, a high reduction rate cannot be employed at the final cold-rolling because this would incur a destabilization of the secondary recrystallization, and hence the magnetic flux density cannot be enhanced because it is not possible to employ the high reduction degree.

The present invention proposes to decarburize steel after the hot-rolling step and before the final cold-rolling step by the C content of from 0.0070 to 0.0300%, thereby allowing a high reduction rate to be used in the final cold-rolling and hence allowing the provision of a thin-gauge grain oriented electrical steel sheet having a high magnetic flux density and a low watt loss.

The present inventors investigated ways by which the sheet thickness could be lessened to 0.10~0.23 mm, and the magnetic flux density and watt loss improved in the process for producing the high magnetic flux density material by using mainly AlN for the inhibitor and a reduction rate at the final cold-rolling exceeding 80%. The present inventors then found that, when the sheet thickness is thin, it is necessary to stabilize or grain-refine the decarburization-annealed base material at the points where the secondary recrystallization will begin. In addition, the secondary recrystallization must be stabilized by increasing the number of nuclei of the secondary recrystallization, i.e., the number of primary recrystallized grains having {110}<001> orientation. Such an increase in the number of nuclei of the secondary recrystallization also will allow the generation of secondary recrystallized grains having a sharp {110}<001> orientation and the decrease in the size of the secondary recrystallized grains.

More specifically, the process according to the present invention comprises: annealing a hot-rolled strip; intermediately cold-rolling the hot-rolled and then annealed strip; and decarburizing, in an amount of from 0.0070 to 0.0300% of C, at a step after the hot-rolling and before the final cold-rolling, thus obtaining a sheet thickness of from 0.10 to 0.23 mm.

DESCRIPTION OF THE PREFERRED EMBODIMENTS

Figure 1A:
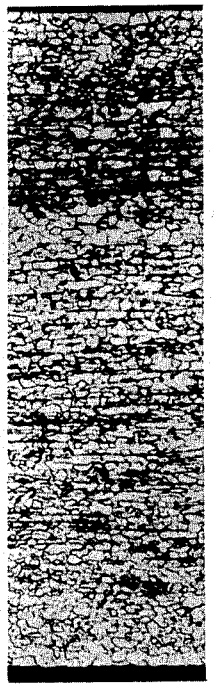
FIGS. 1A, 1B, and 1C are microscopic photographs of the steel sheets prior to the final cold-rolling step.

The starting material of the process according to the present invention is a hot-rolled strip. It is necessary that the hot-rolled strip consist of from 2.5 to 4.0% of Si, from 0.03 to 0.10% of C, from 0.015 to 0.04% of acid-soluble Al, from 0.0040 to 0.0100% of N, from 0.01 to 0.04% of S, from 0.02 to 0.2% of Mn, at least one element selected from the group consisting of 0.04% or less of Se, 0.08% or less of Cu, and 0.4% or less of Sn, Sb, As, Bi, and Cr, and Fe in balance.

A content of silicon (Si) exceeding 4.0% causes serious embrittlement and disadvantageously renders the cold-rolling difficult. At an Si content of less than 2.5%, the electric resistance is too low, making it difficult to obtain an improved watt loss.

A content of carbon (C) of less than 0.03% renders the steel structure such that the quantity of the γ phase obtained prior to the decarburization step is too small, making it difficult to obtain a good primary recrystallized structure. On the other hand, when the C content exceeds 0.10%, a failure in the decarburization annealing will occur.

The acid-soluble Al and N are fundamental elements for obtaining the main inhibitor AlN, which is indispensable in the present invention for providing a high magnetic flux density. When the contents of acid-soluble Al and N fall outside the ranges of from 0.015 to 0.040% and from 0.0040 to 0.0100%, respectively, the secondary recrystallization becomes disadvantageously unstable.

Manganese (Mn) and sulfur (S) are indispensable in the present invention for forming the inhibitor MnS. When the contents of Mn and S fall outside the ranges of from 0.02 to 0.2%, and from 0.01 to 0.04%, respectively, the secondary recrystallization becomes disadvantageously unstable.

In addition to the above mentioned inhibitor-forming elements, at least one element of Se (0.04% or less), Cu (0.08% or less), and Sn, Sb, As, Bi, and Cr (0.4% or less) must be contained. The highest content of these elements must be strictly observed, since the secondary recrystallization is impeded at a content exceeding the highest content.

The hot-rolled Si-steel strip containing the above components, which is the starting material of the process according to the present invention, is annealed and subsequently cold-rolled at least twice to obtain a final sheet thickness of from 0.10 to 0.23 mm. During the cold-rolling steps, an intermediate annealing is carried out. After the final cold-rolling, the decarburization annealing and then the finishing annealing are carried out. The above described production process is an indispensable premise of the present invention and provides a relative stabilization of the secondary recrystallization at a sheet thickness of 0.14 mm or more but not a high magnetic flux density. In accordance with a tendency for a decrease in the magnetic flux density, a low watt loss cannot be obtained, when the process described above per se is carried out. In accordance with the present invention, the carbon is decreased by an amount of from 0.0070 to 0.0300% in an intermediate decarburization step after the hot-rolling and before the final cold-rolling. As a result, the secondary recrystallization is stabilized down to a sheet thickness of 0.10 mm and the magnetic flux density and watt loss can be drastically improved.

Generally speaking, the γ phase, which is formed in steel during hot-rolling, is effective for refining the coarsely grown, elongated grains and hence improving the hot-rolled structure, so as to provide a base structure favourable for causing the growth of secondary recrystallized grains from that structure. The γ phase, therefore, functions to suppress the formation of non-secondary recrystallized regions in the linear form. It is therefore indispensable to add carbon in the steel making stage in an appropriate amount, which is dependent upon the Si content. It is necessary to carry out the decarburization at a step in the course of production, since if carbon remains in final product, it causes magnetic aging. Since any γ phase formation during the secondary recrystallization annealing detrimentally impedes the generation and growth of grains having the objective orientation, the decarburization must be accomplished prior to the finishing annealing step at which the secondary recrystallization occurs. The decarburization step is indispensable in the production steps of the grain-oriented electrical steel sheet because of the reasons described above.

The decarburization according to the present invention is characterized by performing it at a step after the hot-rolling step and before the final cold-rolling and a decarburization amount of from 0.007% to 0.0300%, as described hereinbelow.

The metal structure of steel sheets which have undergone the production steps before the final cold-rolling is described.

The 2.3 mm thick hot-rolled sheet was cold-rolled at a reduction rate of 53% to obtain a 1.07 mm thick sheet.

This sheet was then held at 1130° C. for 30 seconds in a dry mixed gas of 90% $N_2$ and 10% $H_2$, and was then held at 900° C. for 1 minute, followed by cooling by dipping the sheet into water having a temperature of 100° C. The metal structure of the so treated steel sheet is shown in FIG. 1A.

A hot-rolled steel sheet was heated to 1100° C. and held at 1100° C. for 2 minutes within a dry mixed gas of 90% $N_2$ and 10% $H_2$, followed by cooling by dipping the sheet in water having a temperature of 100° C. Subsequently, the cold-rolling and annealing under the same conditions as in A were carried out. The metal structure of so treated steel sheet is shown in FIG. 1B.

A hot-rolled steel sheet was heated to and held at 1100° C. for 2 minutes in a wet mixed gas (dew point 65° C.) of 90% $N_2$ and 10% $H_2$, followed by cooling by dipping the sheet in water having a temperature of 100° C. Subsequently, the cold-rolling and annealing under the same conditions as in A were carried out. The metal structure of the so treated sheet is shown in FIG. 1C.

Figure 1B:
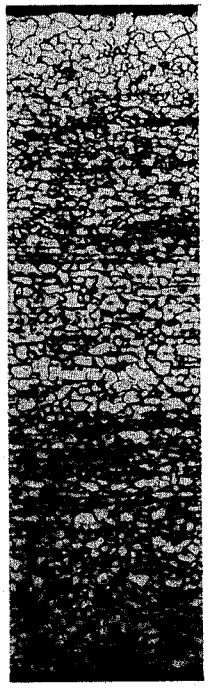

Since the hot-rolled sheets are annealed in the cases of FIGS. 1B and C, the recrystallization therein is thoroughly developed as compared with the case of FIG. 1A, in which the annealing of the hot-rolled sheet is not carried out. It can be understood that, if sheets having the metal structure shown in FIGS. 1B and C are further subjected to final cold-rolling and decarburization annealing, the structure becomes more uniform than that shown in FIG. 1A.

Figure 1C:
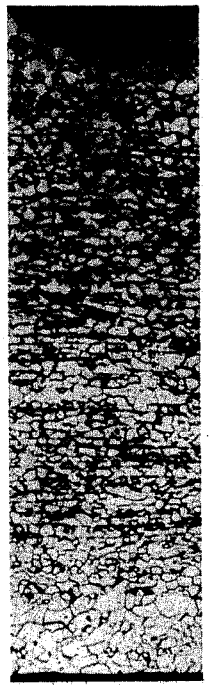

When comparing the surface structures of FIGS. 1B and C, it is apparent that the grains shown in FIG. 1C, in which the annealing atmosphere of hot-rolled sheet is decarburizing, are greater than those shown in FIG. 1B, in which the annealing atmosphere of the hot-rolled sheet is not decarburizing. No appreciable decarburization occurs in the case of FIGS. 1A and B as compared with the initial C content of 0.070%. In the case of FIG. 1C, the decarburization amounts to 0.020% measured along the entire width of a steel sheet. The difference in structures as shown in FIGS. 1A, B, and C exerts a great influence upon the stability of the secondary recrystallization and upon the magnetic properties.

Ten samples having the histories A, B, and C were each subsequently cold-rolled at a reduction degree of 86% to obtain a sheet thickness of 0.15 mm. The samples were then subjected to known decarburization annealing, application of annealing separator mainly composed of MgO, finishing annealing, application of tension wating mainly composed of phosphoric acid-chromic acid anhydride, and baking. The magnetic properties and the secondary recrystallization percentage are given in Table 1.

TABLE 1

| Properties History | A | B | C |
|---|---|---|---|
| Secondary recrystallization percentage | 18 | 85 | 100 |
| $B_8$ (T) | 1.64 | 1.87 | 1.91 |
| $W_{17/50}$ (w/kg) | — | 0.95 | 0.78 |

(Average of n = 10)

As can be seen in the table, case C is considerably superior to cases A and B.

Figure 2:
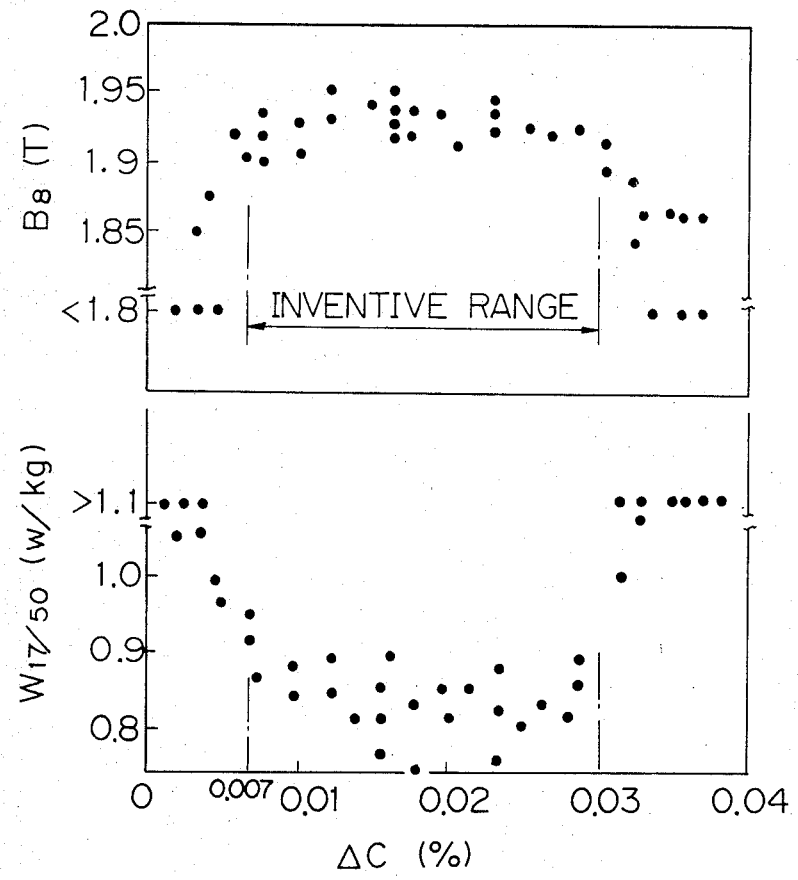
FIG. 2 shows graphs illustrating the relationship between the magnetic properties and the amount of decarburization (ΔC) attained between the hot-rolling step and the final cold-rolling step.

In the tests, the results of which are shown in FIG. 2, the 2.3 mm thick hot-rolled sheets contained 3.25% of Si, 0.078% of C, 0.027% of acid-soluble Al, 0.0083% of N, 0.027% of S, 0.088% of Mn, 0.10% of Sn. The hot-rolled sheets were annealed at 1050° C., first cold-rolled, intermediate annealed at 1100° C., and then heavily cold-rolled at a reduction rate of from 81 to 91% to obtain the final sheet thickness of 0.175 mm. The final cold-rolled sheets were subjected to the known steps of decarburization annealing, application of annealing separator mainly composed of MgO, finishing annealing, and finally application of tension coating mainly composed of phosphoric acid and chromic acid anhydride. The decarburization quantity was varied, in the production steps, by varying the dew point of the annealing gas atmosphere of the hot-rolled strip annealing and/or the intermediate annealing and the application of an aqueous solution of $K_2CO_3$ on the steel sheets prior to their conveyance into the intermediate annealing furnace.

Figure 3A:
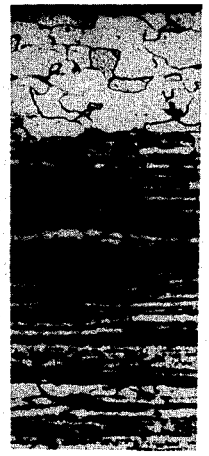
FIGS. 3A and 3B are microscopic photographs of the hot-rolled steel sheets after annealing.

As is apparent from FIG. 2, improved magnetic properties are obtained at a decarburization amount ($\Delta C$) of from 0.0070 to 0.0300%. Although it is novel that the magnetic properties should be improved at the decarburization amount ($\Delta C$) of from 0.0070 to 0.0300%, the reason thereof are not necessarily clarified. The inventors tried to investigate those reasons by experiments, the results of which are shown in FIGS. 3A and B.

Figure 3B:
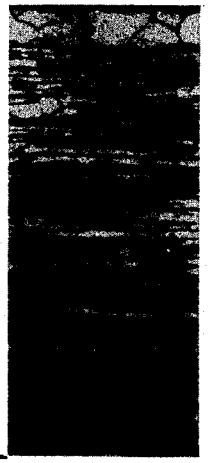

An aqueous 30% $K_2CO_3$ solution was applied (sheet A) and was not applied (sheet B) to the hot-rolled sheets for producing grain-oriented electrical steel sheets. These hot-rolled sheets were heated to and held at 1050° C. for 2 minutes in a dry mixed gas consisting of 90% $N_2$ and 10% $H_2$, followed by cooling by dipping in water having a temperature of 100° C. The optical microscope photographs of the sheets A and B are shown in FIGS. 3A and B, respectively. The decarburization amounts ($\Delta C$) A and B were 0.0150% and 0.0030%, respectively, while the C content of the hot-rolled sheets was 0.072%. The recrystallized region on the sheet surface in FIG. 3A is broader than that in FIG. 3B. Note, it is known that, in the single heavy cold-rolling process using a rate of final reduction exceeding 80%, the secondary recrystallization is destabilized by shaving the surface recrystallization part of the hot-rolled and then annealed sheet. It is, therefore, considered that the secondary recrystallization is stabilized and the magnetic properties are enhanced by increasing the surface recrystallization part due to decarburization. When the surface recrystallization region is made deeper, as shown in FIG. 3A, due to decarburization, the recrystallized grains at the deepest part from the sheet surface are larger than those at the center of the sheet, as shown in FIG. 1C. In a thin steel sheet having a thickness of from 0.10 to 0.23 mm, the thickness of the surface layer where the nuclei of the secondary recrystallization are present, is geometrically thin, and thus such a surface layer is in direct proximity to the outermost part of the steel sheet and therefore is liable to be influenced by the annealing atmosphere during the temperature elevation of the finishing annealing. This may lead to destabilization of the secondary recrystallization and make it difficult to improve the magnetic properties. The decarburization, according to the present invention, carried out at any step after the hot-rolling and before the final cold-rolling, successfully attains a formation of the surface recrystallization until a deep part of the sheet and hence creates the nuclei of the secondary recrystallization at a deep part of the sheet. As a result, it is possible to carry out a heavy reduction at a degree exceeding 80% at the final cold-rolling; which reduction is unfavourable in the light of texture. That is, a thinner grain-oriented electrical sheet than the conventional sheet can be produced, which stabilizing the secondary recrystallization and magnetic properties.

When the amount of decarburization (ΔC) after completion of the hot-rolling and before the final cold-rolling is less than 0.0070%, the effects as described above are unsatisfactory. On the other hand, when the amount of decarburization (ΔC) exceeds 0.030%, the amount of γ phase is too small in the annealing step of the hot-rolled strip, and the intermediate annealing step, to obtain an appropriate primary-recrystallization structure subsequent to the decarburization annealing and to obtain a fine precipitation of AlN. The instability of the secondary recrystallization, where the decarburization amount (ΔC) exceeds 0.0300%, appears to be brought about by such a primary recrystallized structure and AlN precipitation. The maximum sheet thickness of 0.23 mm is the one, above which the intermediate annealing step according to the present invention is unnecessary. The minimum thickness of 0.10 mm is the one, under which the instability of secondary recrystallization occurs even by performing the process according to the present invention.

The reduction rate at the final cold-rolling must exceed 80% to obtain a high magnetic flux density. On the other hand, when the reduction degree at the final cold-rolling exceeds 95%, the texture becomes in appropriate and the destabilization of the secondary recrystallization occurs.

The decarburization according to the present invention can be carried out at any step between the hot-rolling and the final cold-rolling but is advisably carried out during the annealing of the hot-rolled strip at a temperature of from 700° to 1200° C. and the intermediate annealing. The method for decarburization is that of using a wet annealing atmosphere or applying $K_2CO_3$ or the like on the steel sheet, or self annealing of the coiled hot rolled strip by its retaining heat.

The present invention is now described by way of examples.

EXAMPLE 1

The hot-rolled sheets contained 0.065% of C, 3.25% of Si, 0.088% of Mn, 0.026% of S, 0.028% of acid-soluble Al, 0.0075% of N, 0.10% of Sn, and 0.075% of Cu and had a thickness of 2.3 mm. The hot-rolled sheets were annealed at 980° C. for 2 minutes in a wet $N_2$ atmosphere (dew point 62° C.) for the history A, annealed at 980° C. for 2 minutes in dry $N_2$ atmosphere for 2 minutes for the history B, but were not annealed for the history C. The hot-rolled sheets were then picked and cold-rolled at a reduction of approximately 41% to obtain 1.35 mm thick cold-rolled sheets. The cold-rolled sheets were heated and held at 1130° C. for 30 seconds in the dry gas atmosphere of 90% $N_2$ and 10% $H_2$, and then held at 900° C. for 1 minute, followed by quenching. Subsequently, cold-rolling was carried out at a reduction of approximately 83% to obtain 0.225 mm thick cold-rolled sheets. The cold-rolled sheets were subjected to decarburization annealing and the application of an annealing separator, by a known manner, and were then heated, in a gas atmosphere of 10% $N_2$ and 90% $H_2$, at a temperature-elevation rate of 15° C./hour, to 1200° C., followed by purification at 1200° C. for 20 hours. The tension coating was then applied on the steel sheets. The magnetic properties of the product and the decarburization amount (ΔC) after completion of the hot-rolling and before the final cold-rolling are given in Table 2.

TABLE 2

| History | ΔC (%) | $B_8$(T) | $W_{17/50}$ (W/kg) | Remarks |
|---|---|---|---|---|
| A | 0.0090 | 1.93 | 0.82 | Invention |
| B | 0.0040 | 1.91 | 0.90 | Comparative |
| C | 0.0020 | 1.90 | 0.92 | Comparative |

EXAMPLE 2

The hot-rolled sheets contained 0.081% of C, 3.35% of Si, 0.077% of Mn, 0.024% of S, 0.027% of acid-soluble Al, 0.0082% of N, 0.15% of Sn, and 0.08% of Cu and had a thickness of 2.3 mm. The hot-rolled sheets were annealed at 1050° C. for 3 minutes in a wet 90% $N_2$-10% $H_2$ gas atmosphere (dew point 55° C.) for the history A, annealed at 1050° C. for 3 minutes in dry 90% $N_2$-10% $H_2$ gas atmosphere for 3 minutes for the history B, but were not annealed for the history C. The hot-rolled sheets were then pickled and cold-rolled at a reduction of approximately 49% to obtain 1.2 mm thick cold-rolled sheets. The cold-rolled sheets were heated to and held at 1080° C. for 2 minutes in a dry 90% $N_2$-10% $H_2$ gas atmosphere followed by quenching. Subsequently, the cold-rolling was carried out at a reduction of approximately 85% to obtain 0.175 mm thick cold-rolled sheets. The cold-rolled sheets were subjected to decarburization annealing and application of an annealing separator, by a known manner, and then finishing annealed. The tension coating mainly composed of phosphoric acid and chromic and anhydride was then applied on the steel sheets. The magnetic properties of the product and the decarburization amount (ΔC) after completion of the hot-rolling and before the final cold-rolling are given in Table 3.

TABLE 3

| History | ΔC (%) | $B_8$(T) | $W_{17/50}$(W/kg) | Remarks |
|---|---|---|---|---|
| A | 0.0150 | 1.92 | 0.80 | Invention |
| B | 0.0045 | 1.85 | 1.15 | Comparative |
| C | 0.0025 | 1.70 | — | Comparative |

EXAMPLE 3

The hot-rolled sheets contained 0.072% of C, 3.25% of Si, 0.075% of Mn, 0.028% of S, 0.025% of acid-soluble Al, 0.0082% of N, 0.12% of Sn, and 0.08% of Cu and had a thickness of 2.3 mm. The hot-rolled sheets were subjected to application of a 30% $K_2CO_3$ aqueous solution for the history A but this solution was not applied for the history B. The hot-rolled sheets were then annealed at 1100° C. for 3 minutes in a dry 90% $N_2$-10% $H_2$ gas atmosphere, followed by quenching, and were subsequently pickled. The sheets were cold-rolled at a reduction of approximately 53% to obtain 1.07 mm thick cold-rolled sheets. The cold-rolled sheets were heated and held at 1000° C. for 2 minutes in a dry $N_2$ atmosphere. Subsequently, cold-rolling was carried out at a reduction of approximately 86% to obtain 0.150 mm thick cold-rolled sheets. The cold-rolled sheets were subjected to decarburization annealing and application of an annealing separator, by a known manner, and then were finishing annealed. The tension coating mainly composed of phosphoric acid and chromic acid ankydride was then applied on the steel sheets. The magnetic properties of the product and the decarburization amount (ΔC) after completion of the hot-rolling and before the final cold-rolling are given in Table 4.

TABLE 4

| History | ΔC (%) | $B_8$(T) | $W_{17/50}$(W/kg) | Remarks |
|---|---|---|---|---|
| A | 0.0180 | 1.92 | 0.77 | Invention |
| B | 0.0035 | 1.88 | 1.00 | Comparative |

EXAMPLE 4

The hot-rolled sheets contained 0.072% of C, 3.40% of Si, 0.078% of Mn, 0.026% of S, 0.029% of acid-soluble Al, 0.0080% of N, 0.09% of Sn, 0.06% of Cu and 0.028% of Sb and had a thickness of 2.3 mm. The hot-rolled sheets were annealed at 1000° C. for 5 minutes in a dry 90% $N_2$-10% $H_2$ atmosphere, pickled, and cold-rolled at a reduction of approximately 22% to obtain 1.8 mm thick cold-rolled sheets. The cold-rolled sheets were annealed at 1120° C. for 4 minutes in a dry 90% $N_2$-10% $H_2$ atmosphere, followed by rapid cooling, for the history A, an annealed at 1120° C. for 4 minutes in a wet 90% $N_2$-10% $H_2$ atmosphere (dew point 60° C.), followed by quenching, for the history B. The sheets were then pickled and cold-rolled at a reduction of approximately 89% to obtain 0.200 mm thick cold-rolled sheets. The cold-rolled sheets were subjected to decarburization annealing and application of an annealing separator, by a known manner, and then finishing annealed. The tension coating was then applied on the steel sheets. The magnetic properties of the product and the decarburization amount (ΔC) after completion of the hot-rolling and before the final cold-rolling are given in Table 5.

TABLE 5

| History | C (%) | $B_8$(T) | $W_{17/50}$(W/kg) | Remarks |
|---|---|---|---|---|
| A | 0.0050 | 1.88 | 0.98 | Comparative |
| B | 0.0225 | 1.93 | 0.84 | Invention |

We claim:

1. A process for producing a grain-oriented electrical steel sheet, comprising the steps of:

annealing a hot-rolled strip consisting of from 2.5 to 4.0% of Si, from 0.03 to 0.10% of C, from 0.015 to 0.040% of acid-soluble Al, from 0.0040 to 0.0100% of N, from 0.01 to 0.04% of S, from 0.02 to 0.2% of Mn, at least one element selected from the group consisting of 0.04% or less of Se, 0.08% or less of Cu, and 0.4% or less of Sn, Sb, As, Bi, and Cr, and Fe in balance;

cold-rolling at least twice to obtain a sheet having a thickness of from 0.10 to 0.23 mm, in which the final cold-rolling is carried out at a heavy reduction of from more than 80% to 95%;

intermediate annealing between the cold-rolling steps:

decarburization annealing after the final cold-rolling; and, finishing annealing, wherein said process is characterized by providing an intermediate decarburization annealing step after the hot-rolling step and prior to the completion of final cold-rolling and wherein said intermediate decarburization step reduces the C content in an amount of from 0.0070 to 0.0300% based on the total composition of the strip.

2. A process according to claim 1, wherein the intermediate decarburization annealing is carried out in the annealing step of the hot-rolled strip.

3. A process according to claim 1, wherein the intermediate decarburization annealing is carried out in the intermediate annealing step.

4. A process according to claim 1, comprising two intermediate decarburization annealing steps wherein the first intermediate decarburization annealing step is carried out in the annealing step of the hot-rolling strip and the second intermediate decarburization annealing step is carried out in the intermediate annealing step and wherein the total C reduction of the two intermediate annealing steps is in an amount of from 0.0070 to 0.0300% based on the total composition of the strip.

* * * * *

UNITED STATES PATENT AND TRADEMARK OFFICE

CERTIFICATE OF CORRECTION

PATENT NO. : 4,692,193

DATED : Sept. 8, 1987

INVENTOR(S) : Y. Yoshitomi, et al.

It is certified that error appears in the above-identified patent and that said Letters Patent is hereby corrected as shown below:

Column 1, line 26, change "so called" to --so-called--.

Column 1, line 58, change "to decreasing" to --to decrease--.

Column 2, line 26, change "nonhomogenity" to --nonhomegeneity--.

Column 5, line 49, change "wating" to --coating--.

Column 6, line 20, change "reason" to --reasons--.

Column 7, line 1, change "stabilizing" to --stabilizes--.

Column 7, line 26, change "in appropriate" to --inappropriate--.

UNITED STATES PATENT AND TRADEMARK OFFICE

CERTIFICATE OF CORRECTION

PATENT NO. : 4,692,193

DATED : Sept. 8, 1987

INVENTOR(S) : Y. Yoshitomi, et al.

It is certified that error appears in the above-identified patent and that said Letters Patent is hereby corrected as shown below:

Column 7, line 60, change "by" to --in--.

Column 8, line 28, change "by" to --in--.

Column 9, line 28, change "by" to --in--.

Column 8, line 65, change "ankydride" to --anhydride--.

Column 9, line 20, change "an annealed" to --and annealed--.

Column 9, line 41, omit "We claim:"

Column 10, line 1, add --We claim:-- and beging claim 1., "A process for . . ." on the next line.

Signed and Sealed this

Fifth Day of April, 1988

*Attest:*

*Attesting Officer*

DONALD J. QUIGG

*Commissioner of Patents and Trademarks*